US012005312B2

(12) United States Patent
Patrick

(10) Patent No.: US 12,005,312 B2
(45) Date of Patent: Jun. 11, 2024

(54) FOLDABLE WEIGHT TRAINING SLED

(71) Applicant: Knees Over Toes, LLC, Clearwater, FL (US)

(72) Inventor: Ben Patrick, Clearwater, FL (US)

( * ) Notice: Subject to any disclaimer, the term of this patent is extended or adjusted under 35 U.S.C. 154(b) by 101 days.

(21) Appl. No.: 17/938,422

(22) Filed: Oct. 6, 2022

(65) Prior Publication Data

US 2024/0115903 A1 Apr. 11, 2024

(51) Int. Cl.

| | |
|---|---|
| ***A63B 23/04*** | (2006.01) |
| ***A63B 21/00*** | (2006.01) |
| ***A63B 21/005*** | (2006.01) |
| ***A63B 22/20*** | (2006.01) |
| ***A63B 71/06*** | (2006.01) |

(52) U.S. Cl.

CPC ..... *A63B 23/047* (2013.01); *A63B 21/0004* (2013.01); *A63B 21/0056* (2013.01); *A63B 21/0058* (2013.01); *A63B 21/4033* (2015.10); *A63B 22/20* (2013.01); *A63B 2071/0694* (2013.01); *A63B 2210/50* (2013.01)

(58) Field of Classification Search

CPC ... A63B 22/20; A63B 22/2021; A63B 22/203; A63B 22/208; A63B 21/28; A63B 21/285; A63B 21/0004; A63B 21/0056; A63B 21/0057; A63B 21/0058; A63B 21/4033; A63B 21/4035; A63B 69/34; A63B 71/0036

See application file for complete search history.

(56) References Cited

U.S. PATENT DOCUMENTS

| | | | | | |
|---|---|---|---|---|---|
| 3,062,548 | A * | 11/1962 | Foster | A63B 69/34 | 473/445 |
| 4,302,023 | A * | 11/1981 | Kiesz | B62B 3/02 | 108/106 |
| 4,919,416 | A * | 4/1990 | DeCloux | A63B 21/28 | 482/901 |
| 4,984,986 | A * | 1/1991 | Vohnout | A63B 69/06 | 73/379.06 |
| 10,398,926 | B2 | 9/2019 | Baumler et al. | | |
| 10,398,927 | B2 * | 9/2019 | Baumler | A63B 21/0004 | |
| 10,799,750 | B2 * | 10/2020 | Baumler | A63B 21/0056 | |
| 11,179,591 | B1 * | 11/2021 | Bazargan | A63B 69/34 | |
| 2014/0073491 | A1 * | 3/2014 | Gilson | A63B 21/06 | 482/93 |
| 2020/0222741 | A1 * | 7/2020 | Aronson | A63B 21/00069 | |
| 2022/0111251 | A1 * | 4/2022 | Rosenow | A63B 21/0557 | |
| 2022/0226692 | A1 * | 7/2022 | Hsu | A63B 21/00181 | |

* cited by examiner

*Primary Examiner* — Zachary T Moore

(74) *Attorney, Agent, or Firm* — Brad Bertoglio; Intelink Law Group, P.C.

(57) ABSTRACT

Disclosed is a foldable weight training sled for training, where the foldable weight training sled is moved along a substantially linear longitudinal direction. The foldable weight training sled includes a chassis, a first pair of fixed rotatable wheels, a second pair of fixed rotatable wheels, a first pair of foldable push bars, a second pair of foldable push bars, and a measurement device. The foldable push bars may be moved between an upright deployed position, and a folded position wherein the push bars rest along a top side of the chassis.

24 Claims, 7 Drawing Sheets

FOLDABLE WEIGHT TRAINING SLED

BACKGROUND

1. Field

The present disclosure relates in general to exercise equipment for resistance training, and more specifically, to training sleds.

2. Related Art

Training sleds have been used by athletes for resistance training, where the athletes can push the training sleds to promote physical conditioning. In the past these training sleds were big, bulky, and were used by athletes in outdoor environments where generally these types of training sleds had skids that were slid across grass fields. Recently, weight sleds have become more common as indoor exercise equipment where these indoor type of weight sleds generally have wheels that allow a person to push or pull the weight sled along a linear path.

Unfortunately, these types of weight sleds require a significant amount of indoor space and, generally, the loading and unloading of plates of weight on and off the weight sleds. Moreover, these types of weight sleds are generally big and bulky and require a significant amount of floor space to park or store the weight sled when not in use. These types of sleds may also provide little or no feedback to a user indicative of the user's exercise activity, requiring manual tracking and approximation of activity levels. As such, there is a need for a weight sled that addresses these issues.

SUMMARY

Disclosed is a foldable weight training sled for training, where the foldable weight training sled is moved along a substantially linear longitudinal direction. The foldable weight training sled includes a chassis, a first pair of fixed rotatable wheels spaced laterally from one another, a second pair of fixed rotatable wheels spaced laterally from one another, a first pair of laterally spaced foldable push bars, a second pair of laterally spaced foldable push bars, and one or more measurement devices. The chassis has a first end, a second end longitudinally spaced from the first end, laterally spaced sides, a top side, and a bottom side. The first pair of fixed rotatable wheels are mounted to a first axle where the first axle is rotatably attached to the chassis at approximately the first end and the second pair of fixed rotatable wheels mounted to a second axle where the second axle is rotatably attached to the chassis at approximately the second end. The first pair of foldable push bars are attached to the top side of the chassis with a first lockable hinge at approximately the first end and the second pair of foldable push bars are attached to the top side of the chassis with a second lockable hinge at approximately the second end. The first pair of foldable push bars are configured to move the weight training sled in a first direction of travel when a first force is applied to the first pair of foldable push bars in a locked position and the second pair of foldable push bars are configured to move the weight training sled in a second direction of travel when a second force is applied to the second pair of foldable push bars in the locked position, where the second direction of travel is opposite the first direction of travel. Furthermore, the measurement device includes a timer and is located on the top side of the chassis, where the measurement device is configured to provide training information corresponding to a movement of the foldable weight training sled. Moreover, the first and second pair of foldable push bars are configured to rotate from the locked position that is extending vertically upward from the top side of the chassis approximately perpendicular to a folded position that is approximately parallel to the top side of the chassis.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

A foldable, braked, wheeled weight training sled is provided for physical training. Various embodiments may include foldable arms or push bars adapted for to nest within one another when folded, facilitating compact storage including upright storage positions with reduced floor space requirements. One or more measurement devices may also be provided, to assist users in tracking exercise activity performed using the sled.

In particular, the foldable weight training sled can be moved along a substantially linear longitudinal direction is disclosed. The foldable weight training sled includes a chassis, a first pair of fixed rotatable wheels, a second pair of fixed rotatable wheels, a first pair of foldable push bars, a second pair of foldable push bars, and a measurement device. The chassis has a top side, bottom side, first end, and a second end longitudinally spaced from the first end. The first pair of fixed rotatable wheels are mounted to a first axle where the first axle is rotatably attached to the chassis at approximately the first end and the second pair of fixed rotatable wheels are mounted to a second axle where the second axle is rotatably attached to the chassis at approximately the second end. The first pair of foldable push bars are attached to the top side of the chassis with a first lockable hinge at approximately the first end and the second pair of foldable push bars are attached to the top side of the chassis with a second lockable hinge at approximately the second end. The first pair of foldable push bars are configured to move the weight training sled in a first direction of travel when a first force is applied to the first pair of foldable push bars in a locked position and the second pair of foldable push bars are configured to move the weight training sled in a second direction of travel when a second force is applied to the second pair of foldable push bars in the locked position, where the second direction of travel is opposite the first direction of travel. Furthermore, the measurement device includes a timer and is located on the top side of the chassis, where the measurement device is configured to provide training information corresponding to a movement of the foldable weight training sled. Moreover, the first and second pair of foldable push bars are configured to rotate from the deployed position that is extending vertically upward from the top side of the chassis approximately perpendicular to a folded position that is approximately parallel to the top side of the chassis.

Figure 1:
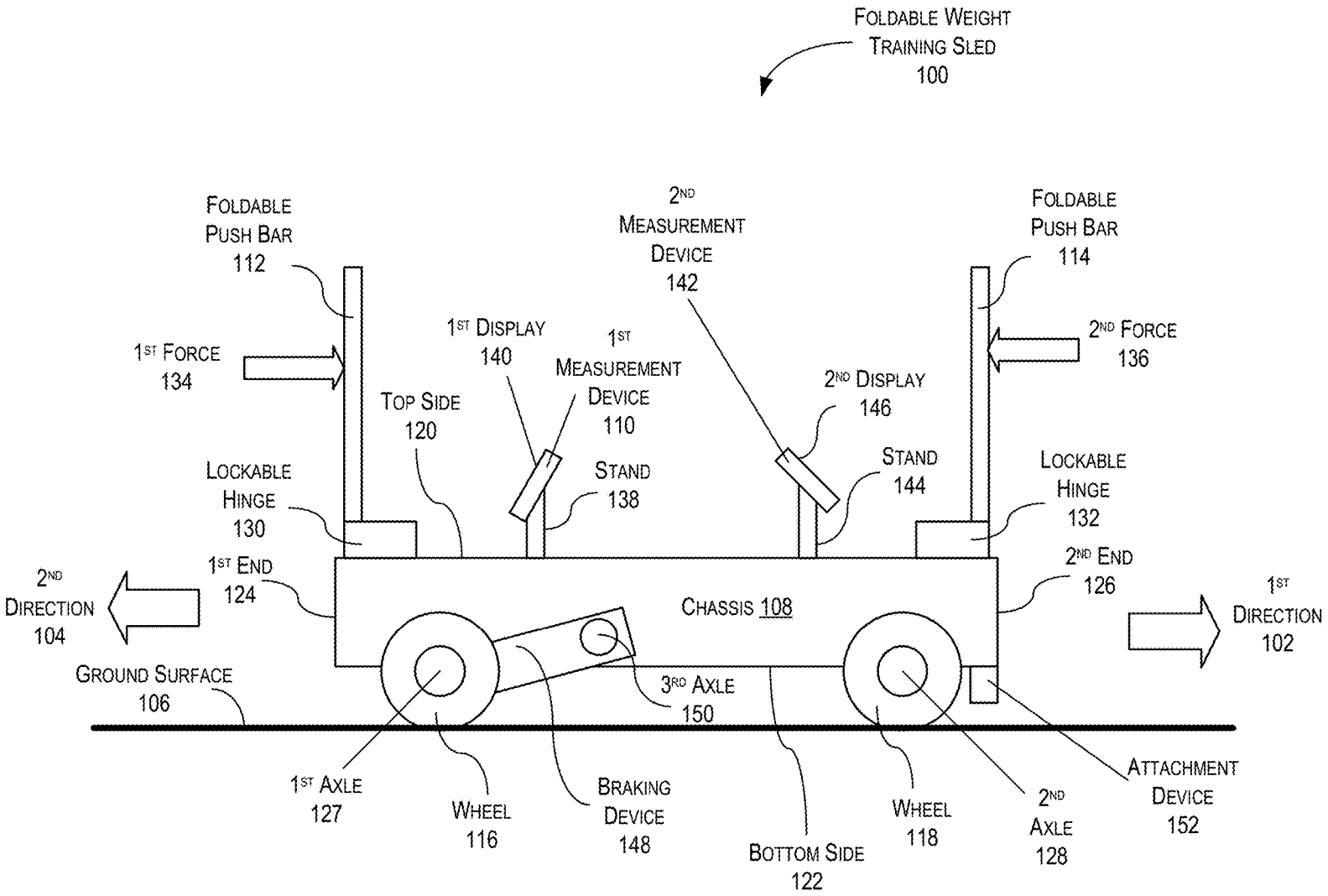
FIG. 1 is a side-view of a simplified system diagram of an example of an implementation of a foldable weight training sled in accordance with the present disclosure.

In FIG. 1, a side view of a simplified system diagram of an example of an implementation of the foldable weight training sled 100 is shown in accordance with the present disclosure. In this example, the foldable weight training sled 100 is configured to move along substantially linear first and second directions 102 and 104 on the ground surface 106. The foldable weight training sled 100 includes a chassis 108, a first pair of fixed rotatable wheels spaced laterally from one another, a second pair of fixed rotatable wheels spaced laterally from one another, a first pair of laterally-spaced foldable push bars, a second pair of laterally-spaced foldable push bars, and a first measurement device 110. Since FIG. 1 is shown as side view of the foldable weight training sled 100, only a single foldable push bar 112 for the first pair of foldable push bars and another foldable push bar 114 for the second pair of foldable push bars is shown. Similarly, only a single rotatable wheel 116 is shown for the first pair of fixed rotatable wheels and another rotatable wheel 118 is shown for the second pair of fixed rotatable wheels.

The chassis 108 has a top side 120, bottom side 122, first end 124, and a second end 126 longitudinally spaced from the first end 124. The first pair of fixed rotatable wheels (including wheel 116) are mounted to chassis 108 via a first axle 127 where the first axle 127 is rotatably attached to the chassis 108 at approximately the first end 124 and the second pair of fixed rotatable wheels (including wheel 118) are mounted to chassis 108 via a second axle 128 where the second axle 128 is rotatably attached to the chassis 108 at approximately the second end 126. In some embodiments, mounting of the first axle 127 at approximately the first end 124 may involve mounting the first axle 127 at a position longitudinally along chassis 108 that is closer to first end 124 than a midpoint of chassis 108 in the longitudinal direction. Likewise, mounting of the second axle 128 at approximately the second end 126 of chassis 108 may involve mounting the second axle 128 at a position longitudinally along chassis 108 that is closer to second end 126 than a midpoint of chassis 108 in the longitudinal direction. Ultimately, the first pair of wheels and the second pair of wheels are preferably spaced longitudinally from one another to support chassis 108 above a support surface, such as the ground.

In some embodiments, it may be desirable to position first axle 127 such that the distance between first axle 127 and chassis first end 124 is less than the radius of wheel 116, such that wheel 116 will extend past first end 124 of chassis 108 and contact first (prior to chassis first end 124) in the event that first end 124 of sled 100 is pushed up against a wall or other object, potentially minimizing impact or damage to such an object as well as chassis 108 due to initial contact with a wheel 116 that may be include e.g. an inflatable rubber tire, foam tire or other component that may be softer or more absorptive of impact as compared to first end 124 of chassis 108. In other embodiments, it may be desirable to position first axle 127 such that the distance between first axle 127 and chassis first end 124 is greater than the radius of wheel 116, such that chassis first end 124 will contact any object against which first end 124 of sled 100 is pushed, thereby protecting movable parts such as wheel 116 and first axle 127 from impact or shock. Similar positioning of second axle 128 relative to second end 126 may be selected, based on such design preferences.

The first pair of foldable push bars (including foldable push bar 112) are attached to the top side 120 of the chassis 108 with a first pair of lockable hinges (including lockable hinge 130) at approximately the first end 124 and the second pair of foldable push bars (including the second foldable push bar 114) are attached to the top side 120 of the chassis 108 with a second pair of lockable hinges (including lockable hinge 132) at approximately the second end 126.

In operation, the first pair of foldable push bars are configured to move the weight training sled 100 in the first direction 102 of travel along the ground surface 106 when a first force 134 is applied to the first pair of foldable push bars (including foldable push bar 112) in a locked, deployed position and the second pair of foldable push bars are configured to move the weight training sled 100 in a second direction 104 of travel when a second force 136 is applied to the second pair of foldable push bars (including foldable push bar 114) in the locked, deployed position. The second direction 104 of travel is opposite the first direction 102 of travel along the ground surface 106. For sake of clarity, it is contemplated and understood that while sometimes referred to herein as a "ground surface", in various embodiments, ground surface 106 could be any type of support surface on which a user may desire to use the sled, including an outdoor ground surface such as grass or turf, indoor flooring, an elevated track, or the like.

In this example, the first measurement device 110 may be supported on the top side 120 by a stand 138 and may include a first display 140 oriented facing chassis first end 124 so that first display 140 is readily visible to a user of sled 100 while pushing foldable push bar 112 in first direction 102. The first measurement device 110 may be physically, electrically and/or magnetically coupled to the first axle 127 and configured to detect and measure the number of rotations that the first axle 127 turns when the corresponding first pair of rotatable wheels (including wheel 116) rotate while moving the weight training sled 100 in either the first direction 102 or second direction 104. As a result, the first measurement device 110 is configured to provide a first training information to a user corresponding to the movement of the foldable weight training sled 100. In this example, the first training information includes a duration time value (e.g. displaying a duration during which a training session takes place), a distance traveled value in the first direction 102, a distance traveled value in the second direction 104, a total distance traveled value, and a speed value.

The foldable weight training sled 100 may also include an optional second measurement device 142 on a stand 144 that is also on the top side 120 of the chassis 108 and includes a second display 146. Second display 146 faces towards second end 126, such that second display 146 is readily visible to a user of sled 100 pushing foldable push bar 114 in second direction 104. In other applications, second display 146 may be viewed by a user pulling sled 100 in first direction 102, and first display 140 may be viewed by a user pulling sled 100 in a second direction 104. In some applications, two individuals may use sled 100 simultaneously, with one of them positioned towards chassis first end 124 and viewing first display 140 and a second individual positioned towards chassis second end 126 and simultaneously viewing second display 146, whereby both individuals may simultaneously monitor information pertaining to their use of sled 100 (e.g. exercise duration, distance, or the like).

In this example, the second measurement device 142 may be also physically, electrically and/or magnetically coupled to the first axle 127 and configured to detect and measure the number of rotations that the first axle 127 turns when the corresponding first pair of rotatable wheels (including wheel 116) rotate while moving the weight training sled 100 in either the first direction 102 or second direction 104. Alternatively, the second measurement device 142 may be instead physically, electrically and/or magnetically coupled to the second axle 128 and configured to detect and measure the number of rotations that the second axle 128 turns when the corresponding second pair of rotatable wheels (including wheel 118) rotate while moving the weight training sled 100 in either the first direction 102 or second direction 104.

In either case, the second measurement device 142 is configured to provide a second training information to the user corresponding to the movement of the foldable weight training sled 100. In this example, the second training information also includes a duration time value, a distance traveled value in the first direction 102, a distance traveled value in the second direction 104, a total distance traveled value, and a speed value. In general, the distance traveled value in the first direction 102 is displayed as a first display distance on the first display 140 of the first measurement device 110 and as a corresponding second display distance on the second display 146 of the second measurement device 142. Similarly, the distance traveled value in the second direction 104 is displayed as a second display distance on the first display 140 of the first measurement device 110 and as a corresponding first display distance the second display 146 on the second measurement device 142. Other parameters may be derived from measured parameters and stored or communicated to a user, such as instantaneous power output and energy (e.g. calorie) expenditure during a training session.

In this example, the first measurement device 110 and second measurement device 142 may be electronic devices, components, processors, or circuits that are linked via either a wired or wireless electrical connection such that information from the first measurement device 110 may be transmitted to and received by second measurement device 142 and vice versa. Both the first measurement device 110 and second measurement device 142 may each include a timer to determine time value measurements for any workouts performed by a user when moving the foldable weight training sled 100. As another example, the foldable weight training sled 100 may also include a wireless transmitter (which may be built into one or more of measurement devices 110 and 142, or located externally) that is configured to transmit the first and/or second training information to a remote wireless receiver (not shown). The remote wireless receiver may be a personal wearable device worn by a user using the foldable weight training sled 100 (e.g. a smartwatch, or Bluetooth headphones) or part of a remote computing device such as, for example, a computer, portable computer, or cellular smart telephone. In this example, the wireless transmitter may be a wireless transmitter that utilizes, for example, IEEE 802.11 WI-FI®communications, IEEE 802.15.1 standard or the Bluetooth Special Interest Group standard for BLUETOOTH® communications, or other wireless standards. In this way, a user's exercise activity with the sled (e.g. duration, speed, power output, distance travelled, resistance levels, etc.) may be displayed by and/or tracked by external devices and software operating thereon.

While the use of one or more measurement devices and displays as described herein may be particularly advantageous when used in combination with the illustrated folding sled designs, it is contemplated and understood that in other embodiments, components including first measurement device 110, second measurement device 142, first display 140, second display 146, first measurement device 226, second measurement device 228, measurement device 302, and systems coupling such components to drive systems and enabling such components to measure activity—may also be advantageously utilized in sled embodiments having two sets of fixed push bars or other push bar configurations.

Returning to the exemplary embodiment of FIG. 1, the first and second pair of foldable push bars (including foldable push bars 112 and 114) are configured to pivot from the deployed position in which the push bars are locked to extend vertically upward from the top side 120 of the chassis 108 approximately perpendicular, to a folded position in which the foldable push bars are approximately parallel to the top side 120 of the chassis 108. Preferably, the first and second pair of foldable push bars will be configured and oriented to nest laterally within one another when folded, in a common plane parallel or approximately parallel to a top side of chassis 108 (e.g. a horizontal plane, when sled 100 is resting on a flat ground surface 106). As an example, in an embodiment in which lockable hinge 130 and lockable hinge 132 are mounted to chassis 108 directly across from one another (i.e. at a same position laterally relative to chassis 108), each of the foldable push bars of the first pair of foldable push bars (including foldable push bar 112) may be a straight bar and each of the foldable push bars of the second pair of foldable push bars (including foldable push bar 114) may be a curved bar that is curved (e.g. flaring outwards from a mounting point of lockable hinge 132 towards an outside edge of chassis 108) so as to not collide with the corresponding straight bar of the first pair of foldable push bars when the first and second pair of foldable push bars pivot from the deployed position to the folded position.

While providing both straight and curved push bars may be desirable in some embodiments, it is contemplated that other configurations may be utilized in order to facilitate use of push bars at each of the first end and second end of chassis 108, while still facilitating folding of the push bars to a common plane parallel or approximately parallel to a top side of chassis 108. For example, each of the first pair of foldable push bars may be a curved bar and each of the foldable push bars of the second pair of foldable push bars may be a straight bar; or both sets of push bars may be straight with one set being angled relative to the other to avoid interference while folded; or both pairs of push bars may be straight and foldable in a longitudinal direction but each of the first pair of lockable hinges may each be positioned on chassis 108 at a different position laterally as compared to each of the second pair of lockable hinges (i.e. each of the hinges is offset laterally from the others) in order to avoid interference between the push bars when folded. In each case, preferably one pair of foldable push bars will have a symmetric type of configuration (whether straight or curved) and the other pair of foldable push bars having another symmetric type of configuration that allows for all the foldable push bars to be folded against the top side 120 of the chassis without interfering or colliding with the other pair of foldable push bars.

In some embodiments, all of the foldable push bars are shown to fold inward into the longitudinal length of the chassis 108, adjacent to a top surface of chassis 108. The curved foldable push bars may be curved optionally inward or outward with the goal being to allow the user to comfortably push the foldable weight training sled 100 in either the first direction 102 or second direction 104. In either case, such embodiments with varying push bar configurations on each end may provide users with multiple push bar configurations from which to choose during training. For example, straight push bars may provide a user with a particular width between bars, while an opposing set of curved push bars flaring outwards towards outer edges of chassis 108 may provide users with a wider grip position.

In these examples, each lockable hinge (including lockable hinges 130 and 132) of the first and second pair of lockable hinges is configured to releasably lock the corresponding foldable push bar of the first and second pair of foldable push bars into the deployed upright position and unlock the corresponding foldable push bar when the foldable push bar is lifted vertically away from the lockable hinge. Each lockable hinge is also configured to pivot the corresponding foldable push bar from the deployed position to the folded position along the top side 120 of the chassis 108. Each lockable hinge may be further configured to releasably lock the corresponding foldable push bar into the folded position.

In this example, the foldable weight training sled 100 further includes a braking device 148 for applying resistance to at least the first axle 127 and/or the second axle 128 via incremental resistance settings. The wireless transmitter may be configured transmit the resistance settings to the remote wireless receiver. Moreover, the braking device 148 may include a third axle 150 on the chassis 108. The third axle 150 may be optionally physically coupled to the first axle 127, second axle 128 or both. In this example, the third axle 150 has a variable resistance mechanism (not shown) that may increase of decrease the amount of friction or resistance to rotation that is applied to the rotation of the third axle 150. The variable resistance mechanism may include, for example, a knob that increases or decrease the tension gripping or frictional resistance to a rotation of the third axle 150, or electromagnetic resistance to rotation of the third axle 150. As an example, the braking device may include a chain drive system that physically couples the third axle 150 to either the first axle 127 or second axle 128.

The foldable weight training sled 100 may further include a storage system that releasably attaches to a vertical surface to store the foldable weight training sled 100 in an upright position for storage when the first pair of foldable push bars and the second pair of foldable push bars are in the folded position. In this example, the storage system may include an attachment device 152 at the bottom side 122 of the chassis 108 for storing the foldable weight training sled 100.

Figure 2:
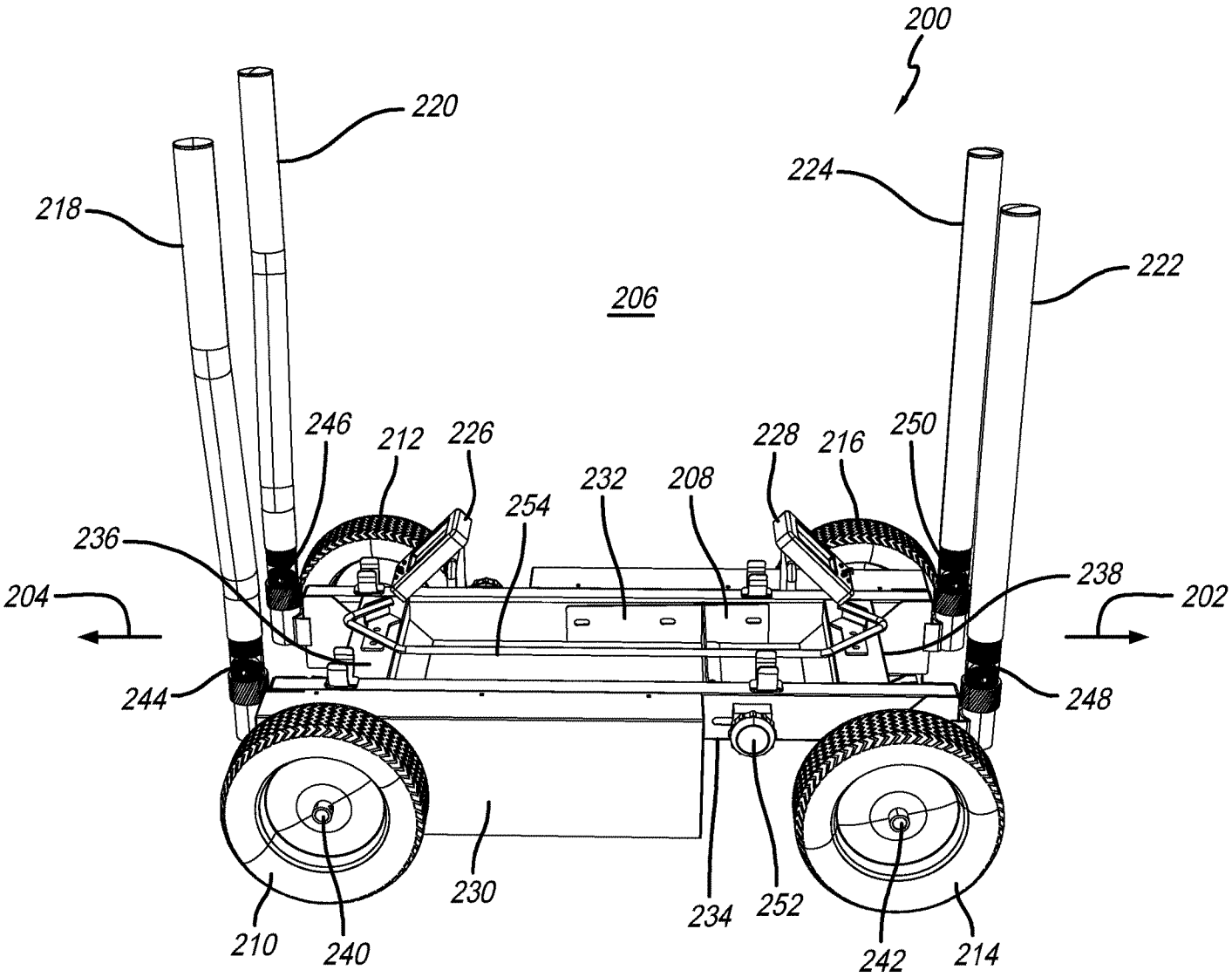
FIG. 2 is a perspective side-view of an example of an implementation of the foldable weight training sled in accordance with the present disclosure.

In FIG. 2, a perspective side-view of an example of an implementation of the foldable weight training sled 200 is shown in accordance with the present disclosure. As described earlier in relation to FIG. 1, the foldable weight training sled 200 is configured to move along substantially linear first and second directions 202 and 204 on the ground surface 206. Again, the foldable weight training sled 200 includes a chassis 208, a first pair of fixed, laterally-spaced rotatable wheels (including wheels 210 and 212), a second pair of fixed, laterally-spaced rotatable wheels (including wheels 214 and 216), a first pair of laterally-spaced foldable push bars (including foldable push bar 218 and foldable push bar 220), a second pair of laterally-spaced foldable push bars (including foldable push bar 222 and foldable push bar 224), a first measurement device 226, a second measurement device 228, and a braking device 230.

The chassis 208 has a top side 232, bottom side 234, first end 236, and a second end 238 longitudinally spaced from the first end 236. The first pair of fixed rotatable wheels (including wheels 210 and 212) are mounted to a first axle 240 where the first axle 240 is rotatably attached to the chassis 208 at approximately the first end 236 and the second pair of fixed rotatable wheels (including wheels 214 and 216) are mounted to a second axle 242 where the second axle 242 is rotatably attached to the chassis 208 at approximately the second end 236.

The first pair of foldable push bars (including foldable push bars 218 and 220) are attached to the top side 232 of the chassis 208 with a first pair of lockable hinges (including lockable hinges 244 and 246) that are laterally spaced from one another and positioned longitudinally at approximately the first end 236. The second pair of foldable push bars (including the second foldable push bars 222 and 224) are attached to the top side 232 of the chassis 208 with a second pair of lockable hinges (including lockable hinges 248 and 250) that are laterally spaced from one another and positioned longitudinally at approximately the second end 238.

As described earlier, in operation, the first pair of foldable push bars 218 and 220 are configured to move the weight training sled 200 in the first direction 202 of travel along the ground surface 206 when a first force is applied to the first pair of foldable push bars 218 and 220 in a locked position and the second pair of foldable push bars 222 and 224 are configured to move the weight training sled 200 in the second direction 204 of travel when a second force is applied to the second pair of foldable push bars 222 and 224 in the locked position.

In this example, the first measurement device 226 may be supported on the top side 232 by a stand and may include a first display. The first measurement device 226 may be physically coupled to the first axle 240 and is configured to detect and measure the number of rotations that the first axle 240 turns when the corresponding first pair of rotatable wheels 210 and 212 rotate while moving the weight training sled 200 in either the first direction 202 or second direction 204. As a result, the first measurement device 226 is configured to provide the first training information to the user corresponding to the movement of the foldable weight training sled 200. In this example, the first training information includes the duration time value, distance traveled value in the first direction 202, distance traveled value in the second direction 204, total distance traveled value, and speed value.

The second measurement device 228 may be also supported on the top side 232 by a stand and may include a second display. In this example, the second measurement device 228 is coupled to the second axle 242 and is configured to detect and measure the number of rotations that the second axle 242 turns when the corresponding second pair of rotatable wheels 214 and 216 rotate while moving the weight training sled 200 in either the first direction 202 or second direction 204. As described earlier, the second measurement device 228 is configured to provide the second training information to the user corresponding to the movement of the foldable weight training sled 200. The second training information includes the duration time value, distance traveled value in the first direction 202, distance traveled value in the second direction 204, total distance traveled value, and speed value. It is appreciated by those of ordinary skill that while the second measurement device 228 is coupled to the second axle 242, the second measurement device 228 may instead be optionally coupled to the first axle 240.

The second measurement device 228 is configured to provide a second training information to the user corresponding to the movement of the foldable weight training sled 200. In this example, the second training information also includes a duration time value, a distance traveled value in the first direction 202, distance traveled value in the second direction 204, total distance traveled value, and speed value. As described earlier, in general, the distance traveled value in the first direction 202 is displayed as first display distance on the first display of the first measurement device 226 and as a corresponding second display distance on the second display of the second measurement device 228. Similarly, the distance traveled value in the second direction 204 is displayed as a second display distance on the first display of the first measurement device 226 and as a corresponding first display distance the second display on the second measurement device 228.

Figure 3:
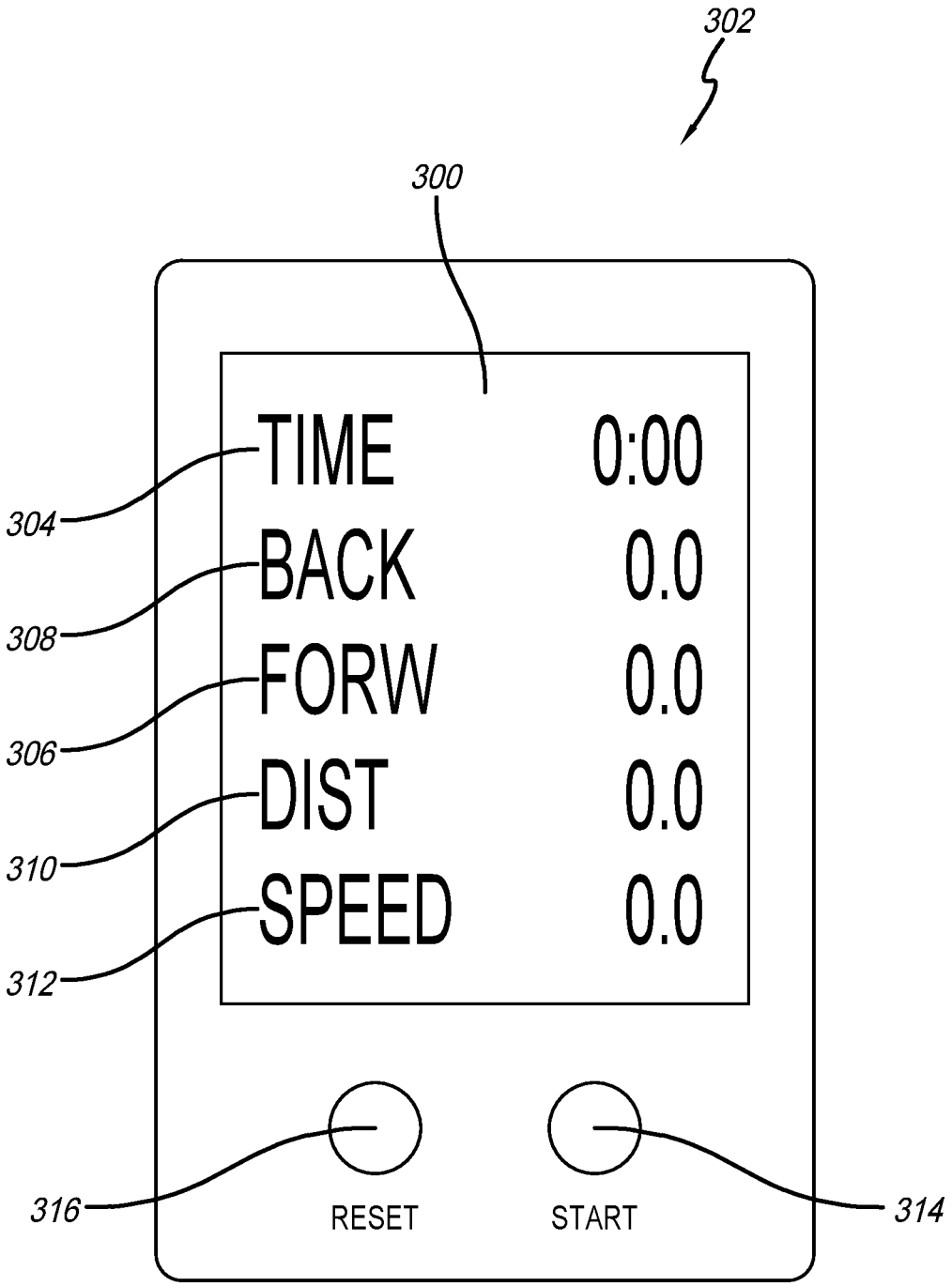
FIG. 3 is front-view of an example of an implementation of a display of a measurement device of the foldable weight training sled in accordance with the present disclosure.

In FIG. 3, a front-view of an example of an implementation of a display 300 of a measurement device 302 (which could be either first measurement device 226 or second measurement device 228) of the foldable weight training sled 200 in accordance with the present disclosure. In this example, the measurement device 302 displays, on the display 300, the training information that includes, for example, the duration time value 304, a distance traveled value 306 in the first direction 202, distance traveled value 308 in the second direction 204, total distance traveled value 310, and speed value 312. The measurement device 302 may also include a start button 314 to start a workout section with the foldable weight training sled 200 and a reset button 316 to reset the workout section and set all the values to zero. First measurement device 110 and second measurement device 142 in the embodiment of FIG. 1 may also be of comparable construction and configuration to that shown in FIG. 3. By providing users with precise information relating to their use of sled 100, exercise programs involving use of a sled may be designed and performed with greater precision and accuracy as compared to conventional sled designs.

Turning back to FIG. 2, each lockable hinge (including lockable hinges 244, 246, 248, and 250) of the first and second pair of lockable hinges is configured to releasably lock the corresponding foldable push bar of the first and second pair of foldable push bars (i.e., foldable push bar 218, 220, 222, and 224, respectively) into the locked position and unlock the corresponding foldable push bar when the foldable push bar is lifted vertically away from the lockable hinge. Each lockable hinge is also configured to pivot the corresponding foldable push bar from the locked position to the folded position along the top side 232 of the chassis 208. Each lockable hinge may be further configured to releasably lock the corresponding foldable push bar into the folded position.

Figure 4:
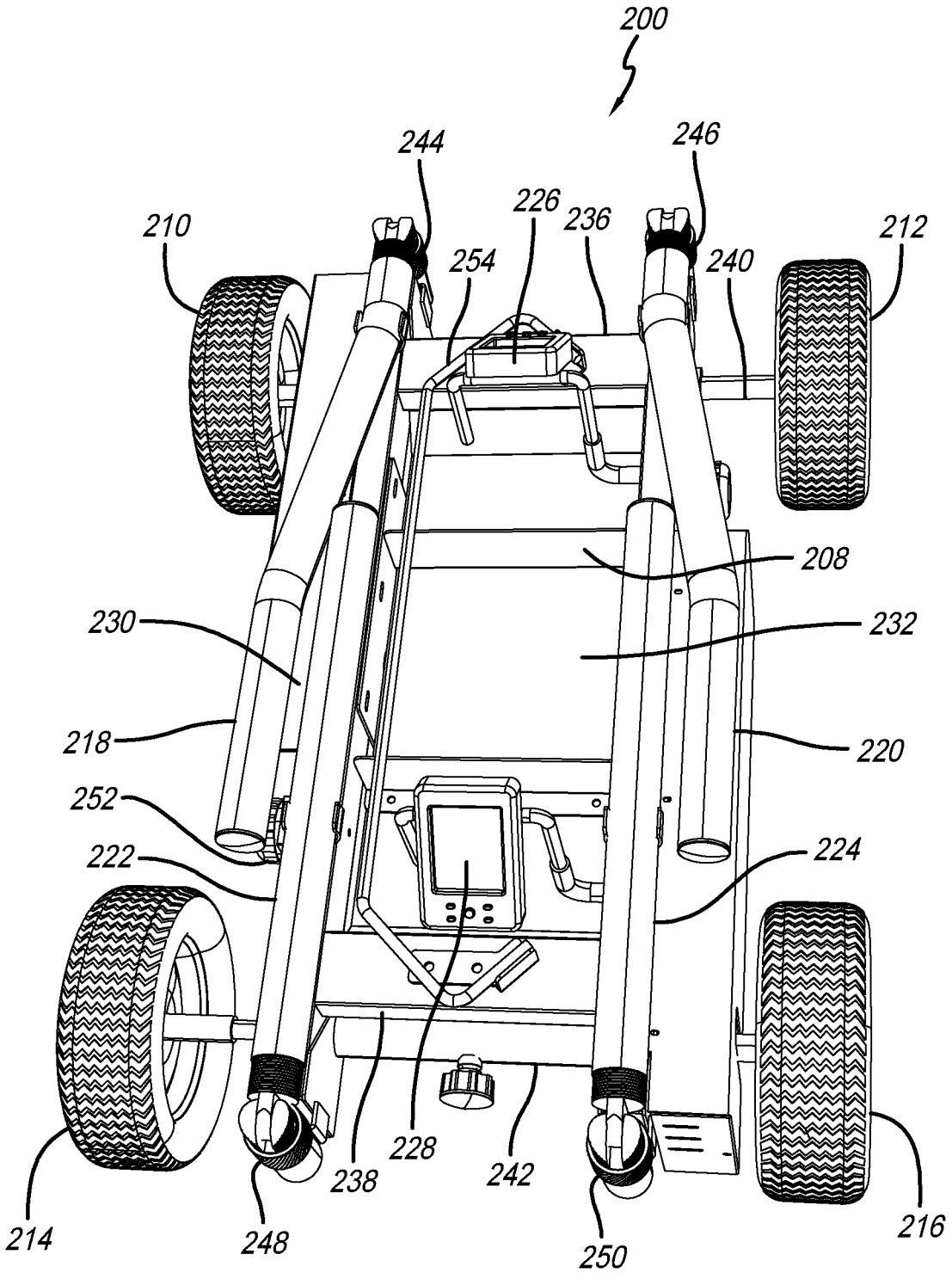
FIG. 4 is a perspective longitudinal top of the foldable weight training sled shown in FIG. 2 in accordance with the present disclosure.

In FIG. 4, a perspective longitudinal top of the foldable weight training sled 200 is shown in the folded position in accordance with the present disclosure. In this example, as described earlier, the first and second pair of foldable push bars (i.e., foldable push bars 218, 220, 222, and 224) are configured to pivot from the locked position that is extending vertically upward from the top side 232 of the chassis 208 approximately perpendicular to the folded position that is approximately parallel to the top side 232 of the chassis 208. In this example, all of the foldable push bars are illustrated in the folded position. Each of the foldable push bars 218 and 220 of the first pair of foldable push bars are shown as curved bars and each of the foldable push bars 222 and 224 of the second pair of foldable push bars are shown as straight bars. In this example, the foldable push bars 218 and 220 of the first pair of foldable push bars are curved so as to not collide with the corresponding straight bars of the second pair of foldable push bars (i.e., foldable push bars 222 and 224) when the first and second pair of foldable push bars pivot from the locked position to the folded position as shown.

While not shown, alternatively, the second pair of foldable push bars may be curved bars and each of the foldable push bars of the first pair of foldable push bars may be a straight bar. As described earlier, the goal is to have one pair of foldable push bars having a symmetric type of configuration (whether straight or curved) and the other pair of foldable push bars having another symmetric type of configuration that allows for all the foldable push bars to be folded against the top side 232 of the chassis 208 without interfering or colliding with the other pair of foldable push bars. In these examples, all of the foldable push bars are shown to fold inward into the longitudinal length of the chassis 208. The curved foldable push bars may be curved optionally inward or outward (as shown in FIG. 4) with the goal being to allow the user to comfortably push the foldable weight training sled 200 in either the first direction 202 or second direction 204.

The foldable push bars (e.g. foldable push bars 112, 114, 218, 220, 222, 224) may sometimes be described or shown herein as residing in a vertical position when locked into place for pushing by a user, and a precisely vertical position may indeed be desirable in some embodiments. A precisely vertical bar position may e.g. be helpful for avoiding slippage of a user's hands along the bar during use.. However, it is contemplated and understood that in some embodiments, the foldable push bars need not be in a precisely vertical position, and the push bars may be lockable into a position that angles e.g. inwards towards an end of a chassis opposite that at which the push bar is mounted, or outwards away from an end of a chassis opposite that at which the push bar is mounted. Further, in some embodiments, the lockable hinges (such as lockable hinges 130, 132, 244, 246, 248 and 250) may be configured to retain associated push bars in adjustable positions when deployed for use, such as a plurality of discrete positions or an adjustable position.

Also shown in FIGS. 2 and 4, the foldable weight training sled 200 may also include a resistance tension knob 252 and a sled strap mount 254. Sled strap mount 254 enables a user to attach to sled 200 components such as a sled strap (not shown) that may be worn around a user's waist or shoulders to facilitate training with sled 200 via a pulling action (as opposed to pushing on the push bars). In the embodiment of FIG. 2, sled strap mount 254 is structured as a partial ring (e.g. roughly in an elongated C shape), formed from a tubular metal bar extending longitudinally along the length of chassis 208, in a plane that is parallel with that of the chassis top side). Sled strap mount 254 includes a first end section proximate chassis first end 236 forming a V shape with the point directed towards second direction 204, and a second end section proximate chassis second end 238 forming a V shape with the point directed towards first direction 202. When used with a sled strap, push bars 218, 220, 222 and 224 may be placed into a folded configuration such as that illustrated in FIG. 4. In such a configuration, a user may attach a sled strap to sled strap mount 254 using a carabiner or other mechanism that enables the sled strap to slide along sled strap mount 254. The user may then pull sled 200 back and forth in opposing directions using the sled strap, without removing and reattaching the sled strap upon each change of direction. For example, when a user pulls sled 200 in first direction 202, a sled strap may pull against a portion of sled strap mount 254 that is proximate second end 238. Upon switching directions, a sled strap may slide along the longitudinal length of sled strap mount 254, passing above folded push arms 218, 220, 222 and 224, until reaching an end of sled strap mount 254 that is proximate first end 236, at which point the user may begin pulling sled 200 in second direction 204. Preferably, sled strap mount 254 will be mounted at an elevation above ground surface 206 that is the same as or similar to the elevation of foldable push bars 218, 220, 222 and 224 when in a folded position, such that a sled strap (when worn by a user in a typical manner at an elevation above that of the sled strap mount) may move around sled strap mount 254 without interference from folded foldable push bars 218, 220, 222 and 224. While the partial-ring embodiment of sled strap mount 254 may be desired in some applications, it is contemplated and understood that other structures may be provided for attachment of straps and other accessories, including, without limitation: separate metal eyelets at each end of the sled chassis; or a continuous (not partial) loop extending longitudinally along the length of the chassis. Also, because in some embodiments sled strap mount 254 will be a strong metal component rigidly and securely mounted to chassis 208, sled strap mount 254 may additionally or alternatively be beneficially utilized as a handle to facilitate users in sliding, lifting, tipping, carrying, tying down, locking, or otherwise moving or securing sled 200 for storage, workout preparation, or other purposes.

The resistance tension knob 252 is coupled to, or optionally part of, a third axle (not shown). The resistance tension knob 252 is a variable resistance mechanism that applies resistance to the third axle via electromagnetic or friction resistance that resists the rotation of the third axle. The third axle is part of the braking device 230 that applies resistance to at least the first axle 240, the second axle 242, or both. In this example, the resistance tension knob 252 provides a resistance setting for the braking device by applying an incremental resistance to the third axle. In this example, the third axle may be coupled to the first axle 240, the second axle 242, or both via a chain drive.

Figure 5:
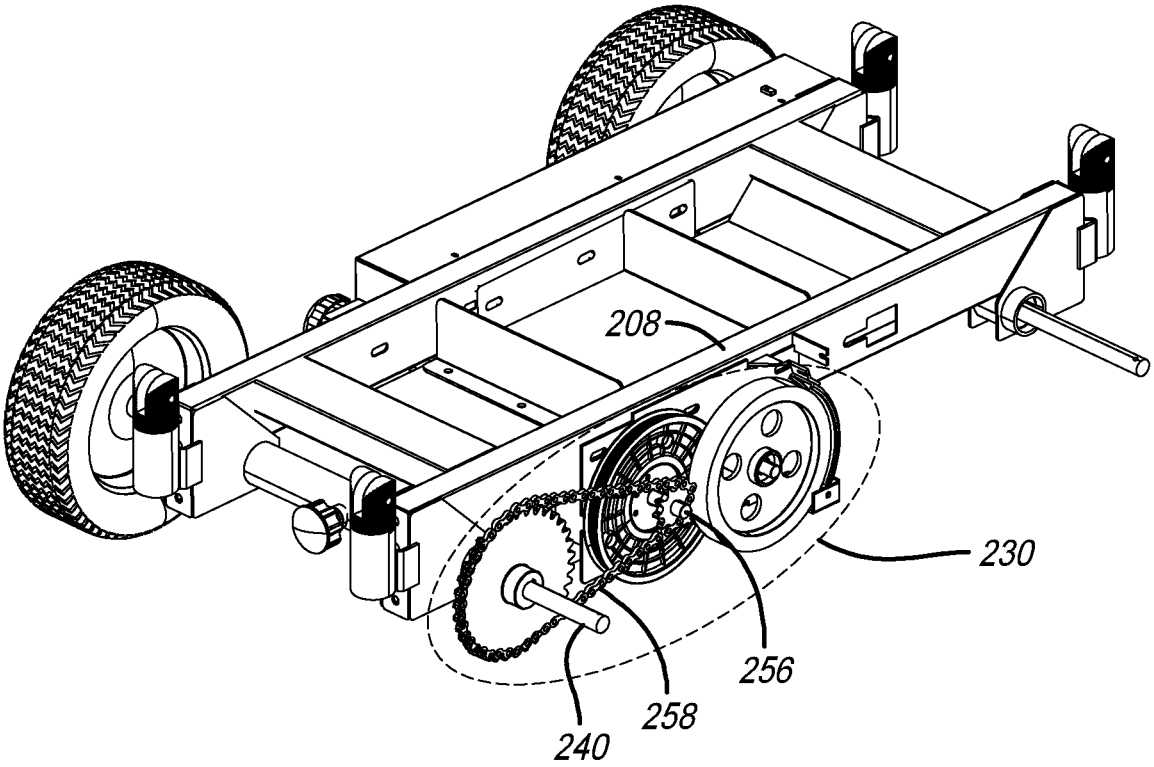
FIG. 5 is a perspective longitudinal side-view of the foldable weight training sled shown in FIGS. 2 and 4 in accordance with the present disclosure.

In FIG. 5, a zoomed in exploded perspective side-view of the braking device 230 for the foldable weight training sled 200 is shown in accordance with the present disclosure. In FIGS. 2 and 4, the braking device 230 is shown having a cover to protect the parts of the braking device 230. In FIG. 5, the cover has been removed exposing the first axle 240 and the third axle 256. In this example, the third axle 256 is physically coupled to the first axle 240 via a chain 258. In an example of operation, once a resistance is set via the resistance tension knob 252, that resistance friction setting is set on the third axle 256, which via the chain 258, causes a corresponding rotational resistance on the first axle 240.

It is appreciated by those of ordinary skill in the art that while a single braking device 230 is shown with a single resistance tension knob 252, the foldable weight training sled 200 may optionally include a second braking system coupled to the second axle 242 with a second resistance tension knob 252.

Turning back to FIGS. 2 and 4, the sled strap mount 254 may also serve as a handle to allow a user to grip, pickup, and move the foldable weight training sled 200. The sled strap mount 254 may be a bar constructed of metal such as, for example, steel or another strong metal. In these examples, the chassis 208, foldable push bars 218, 220, 222, and 224, first, second, and third axles 240, 242, and 256, lockable hinges 244, 246, 248, and 250 may all be constructed of metal such as, for example, steel or other strong metals.

Figure 6:
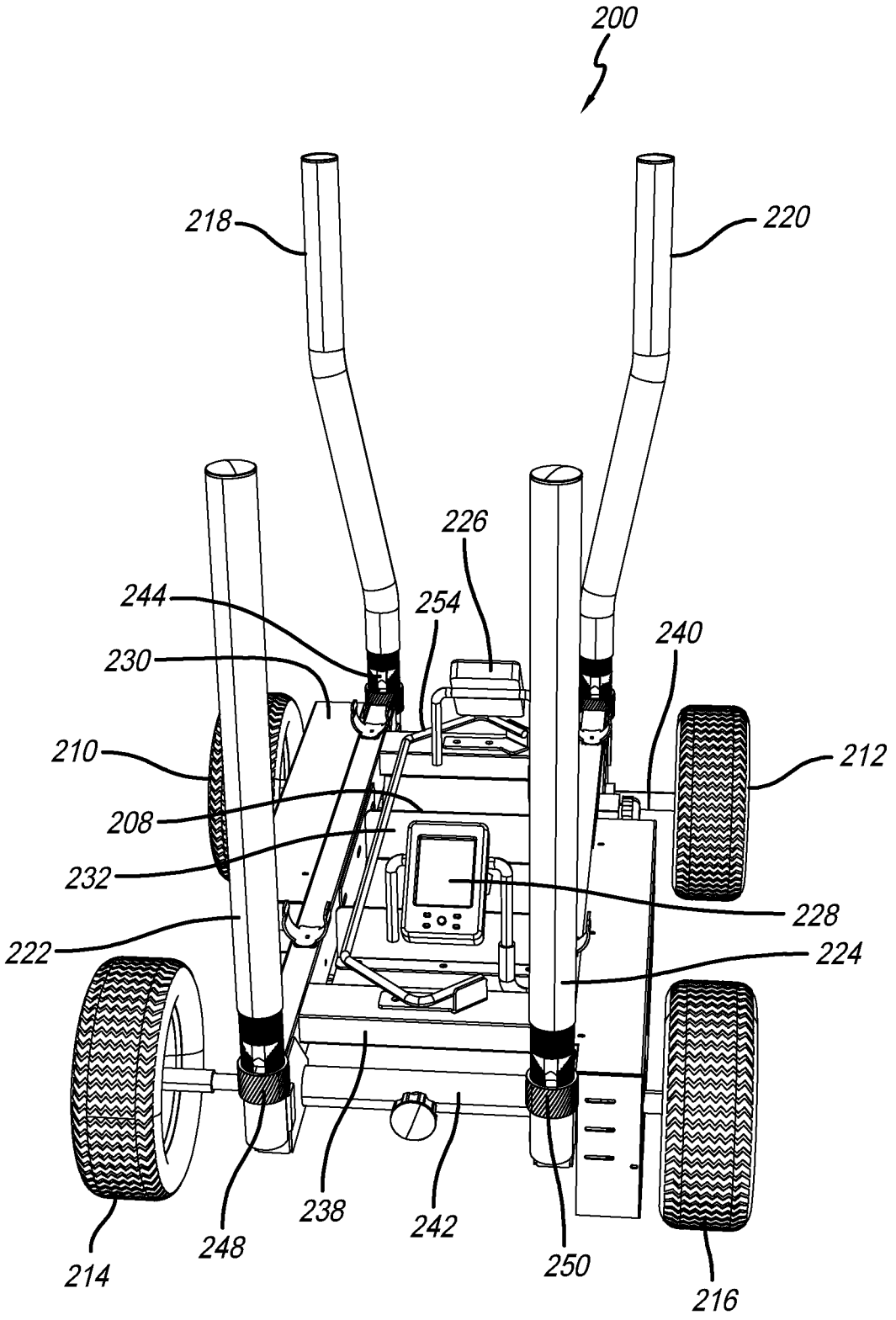
FIG. 6 is a zoomed in perspective side-view of a braking system for the foldable weight training sled shown in FIGS. 3 and 4 through 6 in accordance with the present disclosure.

In FIG. 6, another perspective longitudinal side-view of the foldable weight training sled 200 is shown in accordance with the present disclosure. In this example, the side-view is from the second end 238 of the foldable weight training sled 200 and the foldable weight training sled 200 is shown in the locked position.

In some environments, it may be desirable to reduce floor space required for storage of a weight training sled when not in use. By utilizing folding push arms as described herein, a sled may be tipped upright with arms folded when not in use, thereby greatly reducing the amount of floor space occupied by the sled. However, such sleds are typically heavy devices, such that it may be desirable to reduce risk of accidentally tipping the device and injuring a nearby individual or damaging other nearby objects.

Figure 7:
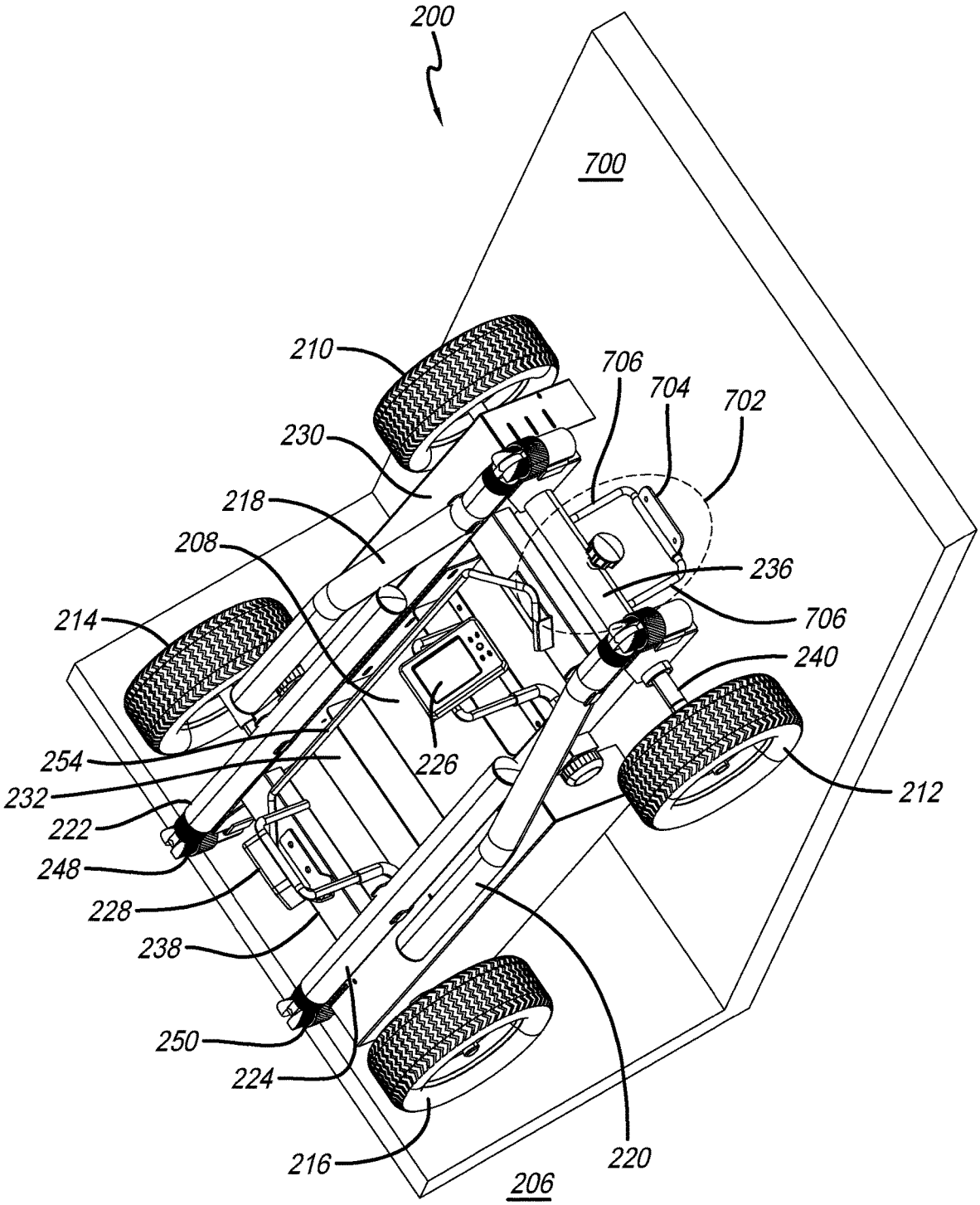
FIG. 7 is another perspective view of the foldable weight training sled shown in FIGS. 2 and 4 through 5 in accordance with the present disclosure.

To that end, turning to FIG. 7, another perspective view of the foldable weight training sled 200 is shown in accordance with the present disclosure. In this example, the foldable weight training sled 200 is stored against a wall 700 with a storage system 702. The storage system 702 is releasably attached to a vertical surface, such as the wall 700, to retain the foldable weight training sled 200 in an upright position for storage when the first pair of foldable push bars 218 and 220 and the second pair of foldable push bars 222 and 224 are in the folded position. In this example, the storage system 702 includes an anchoring device 704 that is attached to the wall 700 and releasable attaching arms 706 that are physically attached to the bottom side of the chassis 208 at the first end 236. As an example, the releasable attaching arms 706 may be physically attached to the bottom side of the chassis 208 via passthrough holes in the chassis 208 and threads and nuts, a locking mechanism that grips the releasable attaching arms 706 once the releasable attaching arms 706 are inserted into the passthrough holes in the chassis 208, or other similar mechanical locking mechanisms.

It will be understood that various aspects or details of the disclosure may be changed without departing from the scope of the disclosure. It is not exhaustive and does not limit the claimed disclosures to the precise form disclosed. Furthermore, the foregoing description is for the purpose of illustration only, and not for the purpose of limitation. Modifications and variations are possible in light of the above description or may be acquired from practicing the disclosure. The claims and their equivalents define the scope of the disclosure. Moreover, although the techniques have been described in language specific to structural features and/or methodological acts, it is to be understood that the appended claims are not necessarily limited to the features or acts described. Rather, the features and acts are described as an example implementations of such techniques.

Conditional language such as, among others, "can," "could," "might" or "may," unless specifically stated otherwise, are understood within the context to present that certain examples include, while other examples do not include, certain features, elements and/or steps. Thus, such conditional language is not generally intended to imply that certain features, elements and/or steps are in any way required for one or more examples or that one or more examples necessarily include logic for deciding, with or without user input or prompting, whether certain features, elements and/or steps are included or are to be performed in any particular example. Conjunctive language such as the phrase "at least one of X, Y or Z," unless specifically stated otherwise, is to be understood to present that an item, term, etc. may be either X, Y, or Z, or a combination thereof.

Furthermore, the description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

It will also be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A foldable weight training sled, where the foldable weight training sled is movable on a support surface along a substantially linear longitudinal direction, the foldable weight training sled comprising:

a chassis having a first end, a second end longitudinally spaced from the first end, laterally spaced first and second sides, a top side, and bottom side;

a first pair of wheels laterally spaced from one another and rotatably mounted to the chassis, and a second pair of wheels laterally spaced from one another and rotatably mounted to the chassis at a location spaced longitudinally from the first pair of wheels, the first and second pairs of wheels operable to support the chassis above the support surface;

a first pair of foldable push bars, each attached to the chassis via one of a first pair of lockable hinges laterally spaced from one another and positioned toward the first end; and a second pair of foldable push bars, each attached to the chassis via one of a second pair of lockable hinges laterally spaced from one another and positioned toward the second end;

wherein the first and second pair of foldable push bars are each configured to pivot between a deployed position in which said push bars extend upward from the top side of the chassis, and a folded position in which said push bars are folded inward towards the chassis such that one of said pairs of push bars nests within the other along the top side of the chassis.

2. The foldable weight training sled of claim 1, wherein the first pair of wheels is mounted to the chassis via a first axle extending laterally from the first side to the second side proximate the first end, and the second pair of wheels is mounted to the chassis via a second axle extending laterally from the first side to the second side proximate the second end.

3. The foldable weight training sled of claim 2, further comprising a first measurement device located on the top side of the chassis, coupled to the first axle to measure rotation of the first axle and display training information corresponding to a movement of the foldable weight training sled along the support surface.

4. The foldable weight training sled of claim 3, wherein the training information includes a duration time value, a distance traveled value, and a speed value.

5. The foldable weight training sled of claim 3, further including a second measurement device located on the top side of the chassis, coupled to the second axle to measure rotation of the second axle and display training information corresponding to movement of the foldable weight training sled along the support surface;

wherein the first measurement device comprises a display facing towards the first end, and the second measurement device comprises a display facing towards the second end.

6. The foldable weight training sled of claim 2, further comprising a braking device for applying resistance to rotation of the first axle; wherein the braking device comprises: a third axle physically coupled to the first axle, and a variable resistance mechanism coupled to the third axle.

7. The foldable weight training sled of claim 6, wherein the third axle is coupled to the first axle via a chain drive.

8. The foldable weight training sled of claim 1, further comprising a first measurement device located on the top side of the chassis displaying training information corresponding to movement of the foldable weight training sled along the support surface.

9. The foldable weight training sled of claim 8, wherein the first measurement device comprises a timer.

10. The foldable weight training sled of claim 8, further including a second measurement device located on the top side of the chassis displaying training information corresponding to movement of the foldable weight training sled along the support surface, wherein the first measurement device comprises a display facing towards the first end, and the second measurement device comprises a display facing towards the second end.

11. The foldable weight training sled of claim 10, wherein the first and second measurement devices are linked, and the displayed training information includes a duration time value, a distance traveled value in a first direction, a distance traveled value in a second direction, a total distance traveled value, and a speed value.

12. The foldable weight training sled of claim 11, wherein the first and second measurement devices are linked via a wired or wireless electrical connection.

13. The foldable weight training sled of claim 8, further comprising a wireless transmitter that is configured to transmit the first training information to a remote wireless receiver.

14. The foldable weight training sled of claim 13, further comprising a braking device applying variable resistance to rotation of at least a first axle or a second axle via an incremental resistance setting, wherein the wireless transmitter is further configured transmit the resistance settings to the remote wireless receiver.

15. The foldable weight training sled of claim 13, wherein the wireless transmitter is a transmitter that utilizes a IEEE 802.15.1 standard or a short ranged wireless communication standard.

16. The foldable weight training sled of claim 1, further including a braking device for applying resistance to rotation of one or more of the first pair of wheels and the second pair of wheels.

17. The foldable weight training sled of claim 1, further including a storage system that releasably attaches to a vertical surface to store the foldable weight training sled in an upright position for storage when the first pair of foldable push bars and the second pair of foldable push bars are in the folded position.

18. The foldable weight training sled of claim 1, wherein each of the foldable push bars of the first pair of foldable push bars is a straight bar and each of the foldable push bars of the second pair of foldable push bars is a curved bar that is curved so as to not collide with the corresponding straight bar of the first pair of foldable push bars when the first and second pair of foldable push bars pivot from the locked position to the folded position.

19. The foldable weight training sled of claim 1, wherein each lockable hinge of the first and second pair of lockable hinges is configured to:

releasably lock the corresponding foldable push bar of the first and second pair of foldable push bars into the deployed position, unlock the corresponding foldable push bar when the foldable push bar is lifted vertically away from the lockable hinge, and pivot the corresponding foldable push bar from the deployed position to the folded position.

20. The foldable weight training sled of claim 19, wherein each lockable hinge is further configured to releasably lock the corresponding foldable push bar into the folded position.

21. The foldable weight training sled of claim 1, further comprising a sled strap mount securely mounted above the top side of the chassis.

22. The foldable weight training sled of claim 21, in which the sled strap mount comprises a steel bar extending longitudinally between the first end and the second end of the chassis.

23. The foldable weight training sled of claim 22, in which the sled strap mount is positioned at a level above the top side of the chassis permitting movement of a sled strap along its length without interference by the first pair of push bars or the second pair of push bars, when the first pair of push bars and the second pair of push bars are in the folded position.

24. The foldable weight training sled of claim 1, wherein in the folded position, the push bars lie within a plane that is parallel to the top side of the chassis.

* * * * *